United States Patent [19]

Martin

[11] Patent Number: 4,986,523

[45] Date of Patent: Jan. 22, 1991

[54] DOCUMENT FEEDER FOR PRINTING EQUIPMENT

[75] Inventor: Emilio B. Martin, Madrid, Spain

[73] Assignee: Amper, S.A., Madrid, Spain

[21] Appl. No.: 346,998

[22] Filed: May 3, 1989

[30] Foreign Application Priority Data

May 4, 1988 [ES] Spain ..... 8801366

[51] Int. Cl.[5] ..... B65H 5/00

[52] U.S. Cl. ..... 271/10; 271/110; 271/119; 271/122; 271/126; 271/147; 271/171; 271/258

[58] Field of Search ..... 271/10, 110, 111, 114, 271/119, 121, 122, 126, 147, 157, 171, 258

[56] References Cited

U.S. PATENT DOCUMENTS

| | | | |
|---|---|---|---|
| 813,810 | 2/1906 | Maynard | 271/122 |
| 3,791,392 | 2/1974 | Hanson | 271/110 |
| 3,857,559 | 12/1974 | McInerny | 271/122 |
| 4,653,742 | 3/1987 | Sasaki et al. | 271/119 |
| 4,858,905 | 8/1989 | Weigel | 271/10 |
| 4,871,162 | 10/1989 | Irai et al. | 271/122 |

FOREIGN PATENT DOCUMENTS

| | | | |
|---|---|---|---|
| 162209 | 5/1953 | Australia | 271/126 |

*Primary Examiner*—H. Grant Skaggs
*Attorney, Agent, or Firm*—Johnson & Gibbs

[57] ABSTRACT

A stack of documents to be supplied to a processing device rest on at least one pull wheel for pulling the documents towards the processing device. A pushing element exerts a constant and uniform force which pushes the stack of documents against the pull wheel. The pull wheel pulls the documents towards a guide. The guide, which is configured such that only one document is permitted to pass through to the processing device, includes a first roller with three toric projections mounted thereon on one side of the guide and a pair of rollers with two toric projections mounted therebetween on the other side of the guide. As the direction of the rollers on opposite sides of the guide rotate in different directions and as the force of rotation of the single first roller is greater than the force of rotation of the two second rollers, the toric projections mounted on opposite sides of the guide will only permit documents to pass therebetween one at a time. The document that rests on the three toric projections is pulled through the guide while the document or documents resting on the two toric projections is pulled backwards. An additional roller is provided to pull the sole document passing through the guide towards a document processor device such as a printer.

36 Claims, 4 Drawing Sheets

DOCUMENT FEEDER FOR PRINTING EQUIPMENT

FIELD OF THE INVENTION

This invention relates to a document feeder for supplying documents to a printing apparatus for the printing of distinctive characters thereon More particularly, this invention relates to a document feeder which provides a unitary pull on documents arranged in a stack, thereby causing the documents to arrive at the printing apparatus.

BACKGROUND OF THE INVENTION

Many different types of printing equipment are used to process various types of documents. For example, banks and similar establishments use printing equipment designed to handle specific types of documents such as standard checks. In processing such checks, it is most often desired to print a series of characters or coded distinguishing marks thereon as a means of identification for the bank. The printing of the characters or distinguishing marks on the document is performed by moving the documents through a printing device or apparatus where marking occurs. The documents may be supplied to the printer by a document feeder which pulls the documents one by one from a storage area and supplies the documents to the printer.

Several document feeders are known where turning wheels pull the document to a guide through which the document passes. In such feeders, a series of documents are stored or stacked in a tray. The stack of documents rest on a set of initial pull wheels or rollers. When the wheels or rollers turn the bottom document of the stack is moved or pulled out of the stack. The document is passed to other rollers that continue the pull and which only permit the massage of a single document. The document is discharged toward the printing station where printing on the document will occur. A motor driven drive and/or gear system is provided with such systems for starting and stopping the movement of the pull rollers as necessary to accomplish the above-identified operation.

There are a number of disadvantages with these types of devices. In such devices, the tray or plate that supports the stack of documents to be processed is pressed toward the pull wheels by a spring or similar device. As a result, when the stack of documents is of considerable height, the push achieved by the spring is high. However, when the stack of documents becomes low, the push of the spring is reduced by a cOnsiderable amount. The pressure on the pull wheels exerted by the document stack differs, therefore, depending on the number of documents stacked. As a result, the pressure exerted by the device on the pull wheels differs for each document which is pulled by the pull wheels. Additionally, such feeders are intended to process documents of a specific length and are unable to adapt to documents of different length.

Another disadvantage of such feeders is that the selection means which allow only one document to pass through the guide at a time is most typically comprised of a single pair of tangential rollers. Selection of the single document, is achieved, therefore along a line which is the tangent to both rollers. Such a configuration is disadvantageous and may result in a reduced effectiveness of the selection means.

The document feeder proposed by the invention has been designed to fully resolve these problems, offering for that purpose a simple, effective structure in operation and purpose.

SUMMARY OF THE INVENTION

A stack of documents to be supplied to a processing device rest on at least one pull wheel for pulling the documents towards the processing device. The stack of documents are supported by a slotted, inclined plate. A pushing element which is guided by the slot, exerts a constant and uniform force which pushes the stack of documents against the pull wheel. The pull wheel, which preferably includes a lateral protection for striking the documents to separate documents stuck together, pulls the documents towards a guide. The guide, which is configured such that only one document is permitted to pass through to the processing device, includes a first roller with three toric projections mounted thereon on one side of the guide and a pair of rollers with two toric projections mounted therebetween on the other side of the guide. As the direction of the rollers on opposite sides of the guide rotate in different directions and further as the force of rotation of the single first roller is greater than the force of rotation of the two second rollers, the toric projections mounted on opposite sides of the guide will only permit documents to pass therebetween one at a time as the single first roller will tend to pull forward to advance the document while two second rollers will tend to move the same document backward. As a result, the document that rests on the three toric projections is pulled through the guide while the document or documents resting on the two toric projections is pulled backwards. An additional roller is provided to pull the sole document passing through the guide to the feeder outlet where, for example, a document processor such as a printer may be provided.

It is a feature of this invention that the inclined tray or plate which supports the stack of documents to be supplied to the guide is provided with a slidable external bar which may be extended or withdrawn such that documents of various lengths may be stacked and processed.

It is another feature of this invention that the plate which supports the stack of documents to be supplied to the guide includes a slot through which a pushing component which exerts a constant, uniform pressure on the stack regardless of the number of documents in the stack, is mounted.

It is yet another feature of this invention that the pull wheels upon which the documents are stacked include lateral projections for striking the documents when the pull wheels are rotated, thereby separating documents which may be stuck together.

BRIEF DESCRIPTION OF THE DRAWING

The present invention may be better understood, and its numerous objects, features and advantages will become apparent to those skilled in the art by reference to the accompanying drawings in which.

DETAILED DESCRIPTION OF THE INVENTION

Figure 1:
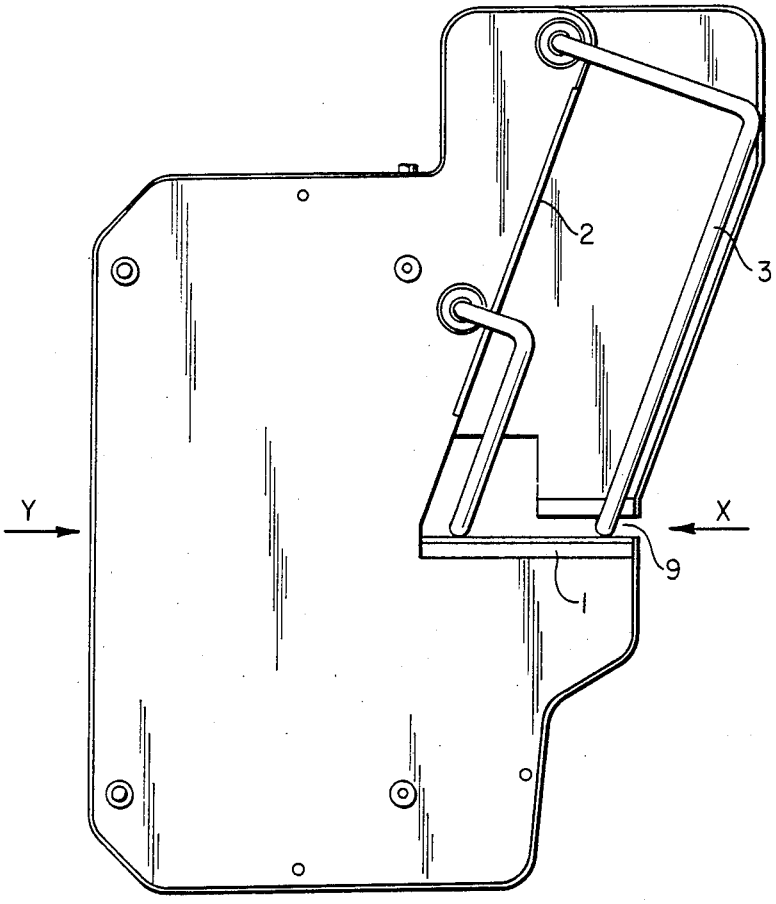
FIG. 1 is a side view of a document feeder constructed in accordance with the teachings of the present invention.

Turning first to FIG. 1, a side view of a document feeder constructed in accordance with the teachings of the present invention may be seen The document feeder illustrated is of the type which stores a plurality of documents and then supplies the stored documents to a processing device such as printer.

The document feeder includes guide for supplying documents to a processing device (not shown) such as a printer. A stack of documents (also not shown) to be supplied to guide 1 are supported in the document feeder by inclined plate 2. So that the document feeder may process documents of differing length, bar 3 is received in a corresponding opening in plate 2. Bar 3 may be extended or retracted with respect to plate 2 so that the effective length of plate 2 increased or decreased. In such a manner documents of differing length may be utilized with the document feeder.

Figure 2:
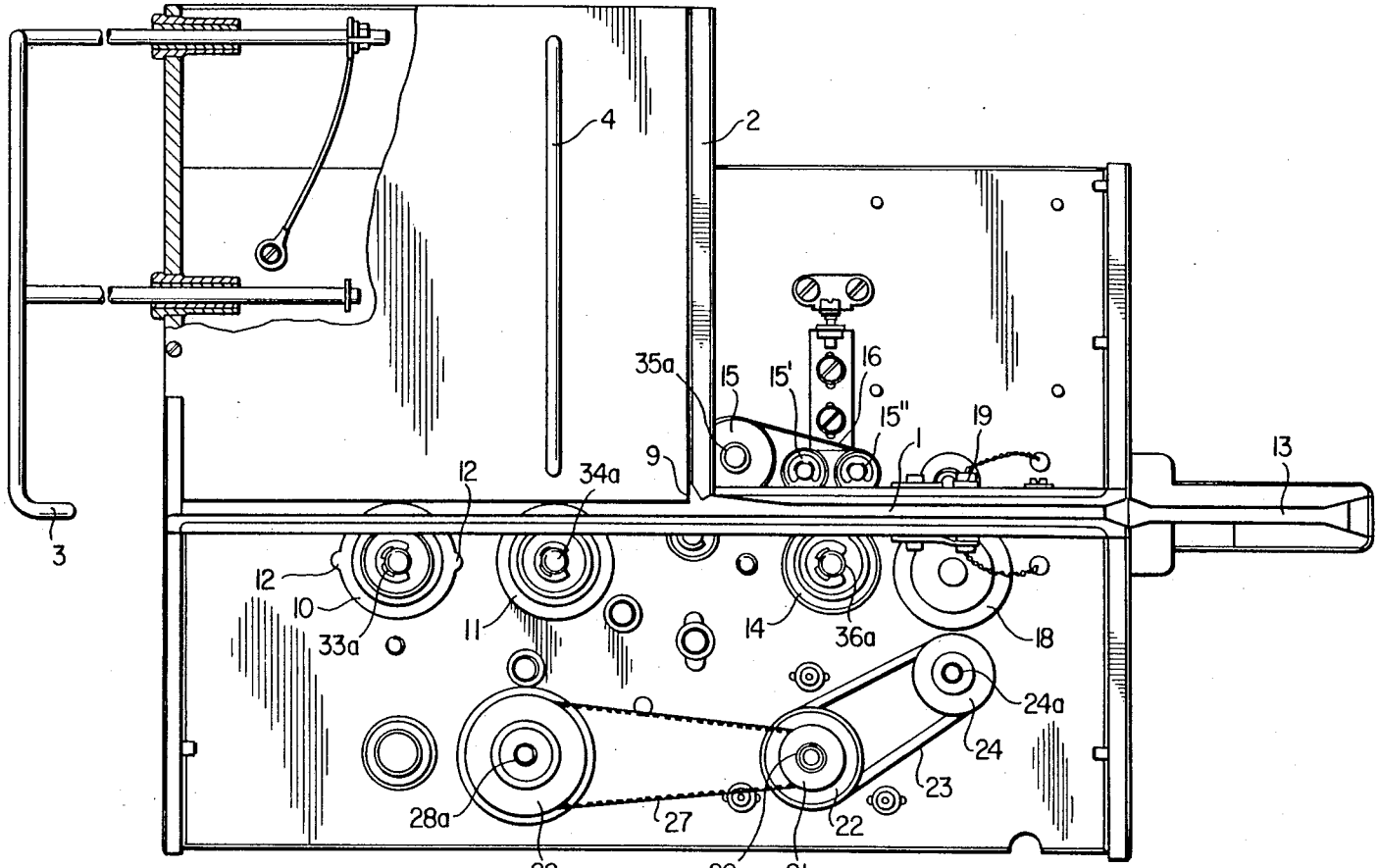
FIG. 2 is a view of a portion of the document feeder of FIG. 1 taken from the direction corresponding to arrow X of FIG. 1.

Turning next to FIG. 2, a portion of the document feeder of FIG. 1 viewed from the direction corresponding to arrow X of FIG. 1 may now be seen. Inclined plate 2, which is intended to support a stack of documents to be supplied to guide 1, is provided with slot 4 for guiding a pushing device (not seen in FIG. 2). The pushing device presses on the stack of documents supported by plate 2 such that the documents are constantly and uniformly pressed against at least one pull wheel as to be more fully described later.

Figure 6:
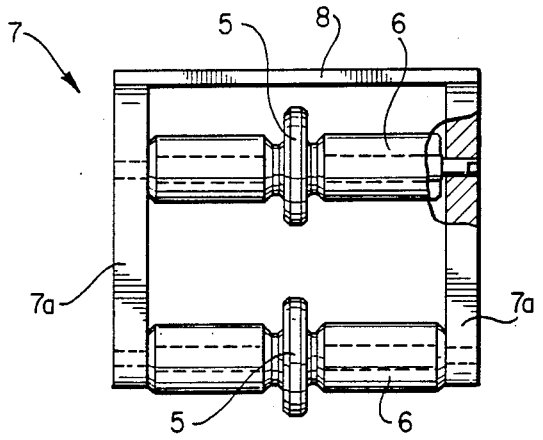
FIG. 6 is a second view Of the pushing device illustrated in FIG. 5.
Figure 5:
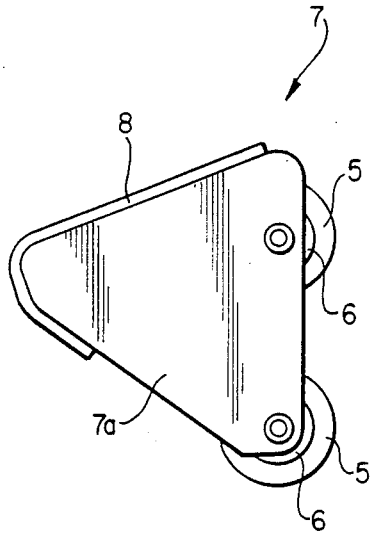
FIG. 5 is a first view of the pushing element for exerting a constant, uniform force On the stack of documents.

Turning now to FIGS. 5 and 6, the pushing device for continuously and uniformly pressing the stack of documents supported by inclined plate 2 against the aforementioned at least one pull wheel may now be described in greater detail. Pushing device 7 includes a pair of plates *7a* substantially parallel to each other between which wheels 5 are positioned. Wheels 5 are supported between plates *7a* by rollers 6 which are rotatably mounted to plates *7a*. Preferably, each wheel 5 should be attached to a corresponding roller 6 at the midpoint of the roller. In such a manner, when wheels 5 are guided by slot 4, pushing device 7 is mounted such that, due to its own weight, it will press constantly on the stack of documents. More specifically wall 8 of pushing device 7 will, by means of the force of gravity, press on the top document included in the stack of documents such that the documents are constantly and uniformly pressed against the aforementioned at least one pull wheel.

The exemplary embodiment of pushing device 7 illustrated in FIGS. 5 and 6 should in no means be considered restrictive on this particular embodiment of the invention. It is envisioned that pushing device 7 may provided in numerous other configurations which will also accomplish the aforementioned object of providing a means of exerting a constant and uniform pushing force on the stack of documents. It is further envisioned that the constant and uniform pushing force is to be provided by gravity and not by spring force as disclosed by traditional devices which, for the reasons previously set forth, cannot exert equal pressure when a large stack of documents are supported by inclined plate 2 and when only a few documents are supported by inclined plate 2. For example, it is further contemplated that pushing device 7 may be comprised of an arm guided in slot 4 of plate 2. A fork having two tines extends from the arm and a roller is mounted between the two fork tines. The roller presses against the stack of documents supported by inclined plate 2 tO exert the desired constant and uniform force.

Returning to FIG. 2, the documents will be supported by inclined plate 2 in a stack transverse to slot 4. The documents will, therefore, be properly orientated to enter guide 1 through guide entry 9. As may now be seen in FIG. 2, the stack of documents supported by the document feeder will rest on a pair of pull wheels or rollers 10 and 11 positioned at guide entry 9 of guide 1, thereby exerting a constant and uniform force on pull wheels 10 and 11.

The rotation of pull wheels 10 and 11 exerts a force on the documents which will urge documents at the bottom of the stack through guide entry 9 and into guide. It is entirely possible, however, that more than one document will be simultaneously urged by pull wheels 10, 11 through guide entry 9 and guide 1. One possible cause of pull wheels 10, 11 simultaneously urging more than one document through guide entry 9 and guide 1 is the tendency of documents, particularly new documents, to stick together. Accordingly, pull wheel 10 is provided with projections 12 on its outer surface so that when roller 10 rotates, projections 12 will strike the bottom document of the stack, thereby causing a vibration on the stack of documents which will cause documents stuck together to separate.

Despite such a document separation feature, it is still possible that more than one document will be simultaneously urged by pull wheels 10, 11 through guide entry 9 and into guide 1. Furthermore, as printing or other processing devices are typically configured to print on a single document at a time, it is preferable that guide 1 include document selecting means so that when more than one document simultaneously enters guide 1, only one document at a time will reach guide outlet 13.

Figure 4:
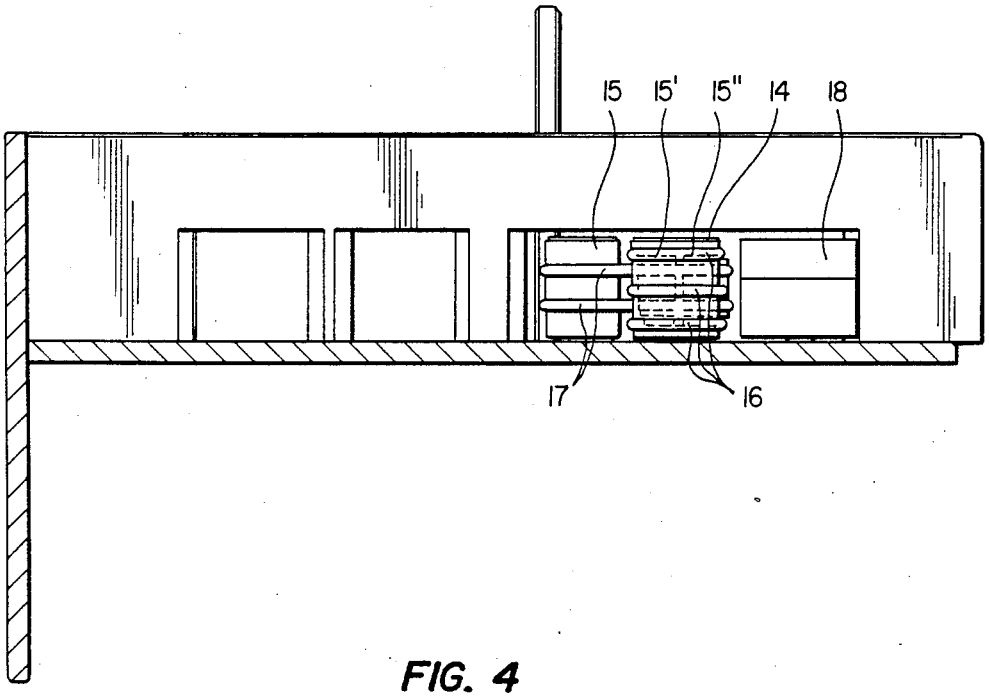
FIG. 4 is a view of rollers and corresponding toroidal rubber wheels which comprise the document selector portion of the document feeder.

Referring now to FIGS. 2 and 4, the means for selecting a single document to pass through guide 1 shall now be more fully described. The selecting means includes a set of rollers comprised of a first roller 14 arranged on one side of guide 1 and three rollers 15, 15′ and 15″, arranged on the other side of guide 1. As may be best seen in FIG. 4, roller 14 is provided with three toric projections such as toroidal rubber wheels 16. Also between rollers 15 and 15″, two additional toric projections such as toroidal rubber wheels 17 are provided. Toroidal rubber wheels 17 are supported on intermediate roller 15′. Referring again to FIGS. 2 and 4, it may be clearly seen that roller 15 is positioned forward of roller 14 on the one side of guide 1 and forward of rollers 15′ and 15″ on the other side of guide 1. It may be further seen that roller 15 is positioned in a wider portion of guide 1 and rollers 14, 15′, and 15″ are positioned in a narrower portion of guide 1.

Roller 14 rotates in the same direction of the advancing documents, i.e. the direction which would pull entering documents toward outlet 13. Rollers 15, 15', 15'', on the other hand, revolve in the opposite direction to the advancing documents, i.e. the direction which would tend to pull the documents back towards guide entry 9. Accordingly, when documents enter guide 1 through guide entry 9, the documents will attempt to pass between roller 14 and rollers 15, 15', 15''. For the reasons to be described in detail below, only a single document entering guide 1 shall be permitted to pass by means of the described set of rollers with their corresponding toroidal rubber wheels.

Following rollers 14 and 15, 15', 15'', there is an additional pull wheel 18. Pull wheel 18 pulls the single document selected by rollers 14 and 15, 15', 15' towards outlet 13. A photo detector 19 is positioned to detect documents being pulled by pull wheel 18. In such a manner photo detector 19 detects the discharge of each single document. Photo detector 19 gives appropriate orders, as discussed below when a document is detected.

Figure 3:
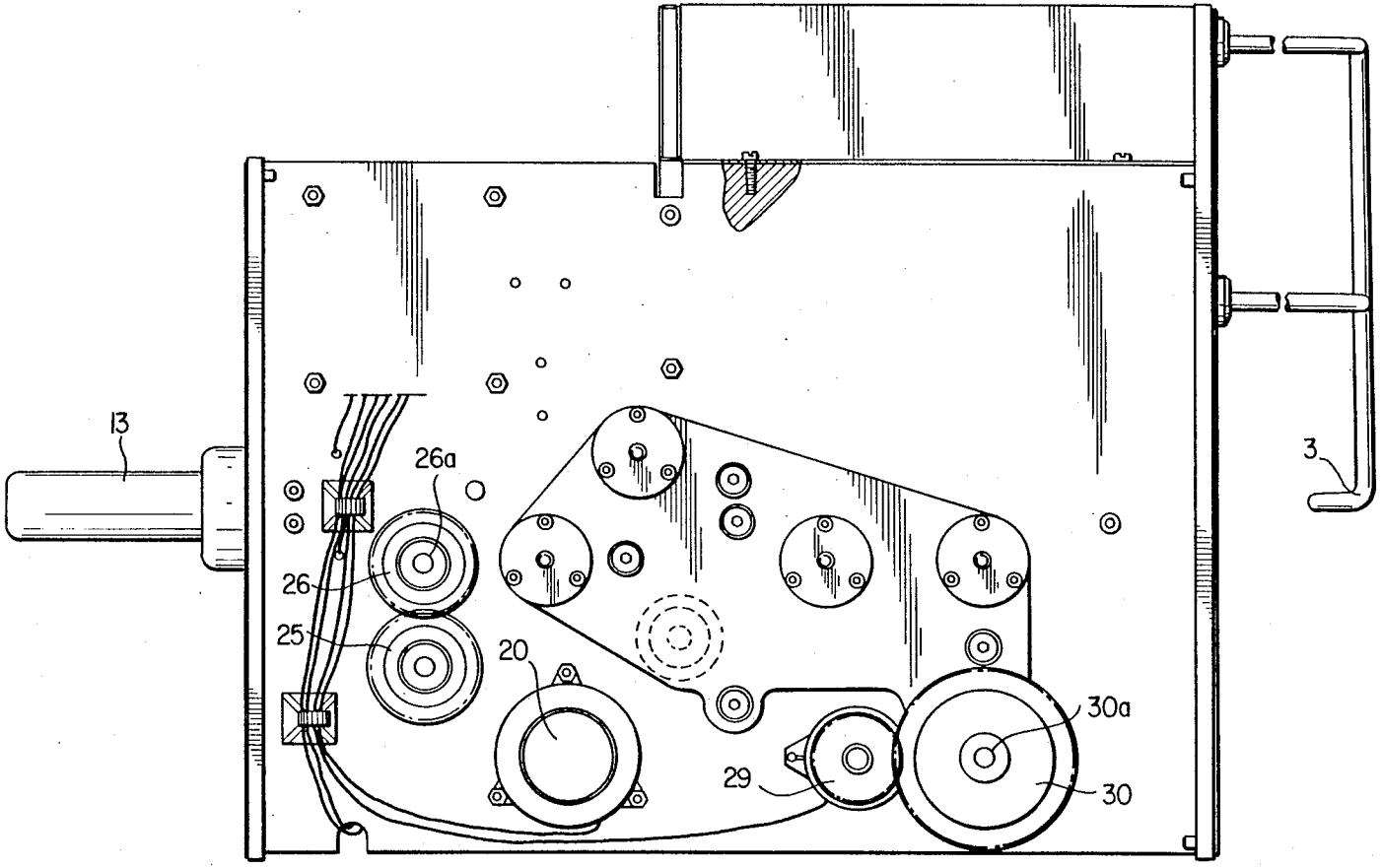
FIG. 3 is a second view of the portion of the document feeder of FIG. 1, this time, taken from the direction corresponding to arrow Y of FIG. 1.

Returning now to FIGS. 2 and 3, the drive system which rotates the multiple rollers and wheels which pull the documents through the document feeder is now described in greater detail. The drive system which rotates the multiple rollers includes a motor 20 of conventional design. Sprocket 21 is mounted on drive shaft 20*a* of motor 20. Accordingly, rotation of the drive shaft 20*a*, in turn rotates sprocket 21. Pulley 22 is coaxially mounted on sprocket 21. Pulley 22 is also connected to pulley 24 by belt 23. The rotation of pulley 24 turns drive shaft 24*a*. Mounted on the opposite end of drive shaft 24*a* is sprocket 25. Sprocket 25, in turn meshes with sprocket 26. The rotation of sprocket 26 turns drive shaft 26*a*. Finally, wheel 18, which produces the pull for the final discharge of the document, is mounted on drive shaft 26*a* with sprocket 26.

Again referring to FIG. 2, sprocket 21 is also connected through toothed belt 27 with ring gear 28. Ring gear 28 is mounted on shaft 28*a*. Mounted on shaft 28*a* is a clutching mechanism (not shown) such as a clutch for engaging and disengaging sprocket 29 from shaft 28*a*. Sprocket 29, in turn, meshes with tooth wheel 30.

Figure 7:
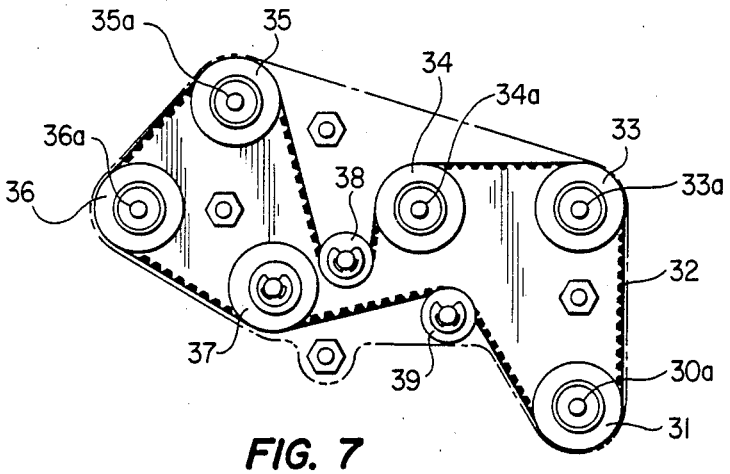
FIG. 7 is a view of the drive system for pulling and selecting documents.

Turning next to FIG. 7, the set of wheels interconnected by a toothed chain which comprise the drive system for the various wheels or rollers which pull and/or select the document to be passed through guide 1 is now described in detail. Toothed wheel 30, which is rotated by sprocket 29 (see FIG. 3) is mounted on drive shaft 30*a*. Similarly, wheel 31 is also mounted on drive shaft 30*a*. In turn wheel 31, through the toothed chain or belt 32, is connected with wheels 33, 34, 35, 36 and 37 as well as with corresponding tensor wheels 38 and 39.

While not apparent from FIG. 7 alone, the drive system shown in FIG. 7, moves the initial pull wheels or rollers 10 and 11 as well rollers 14 and 15, 15', 15'' which comprise the means for selecting a single document to be passed through guide 1. Both wheel 33 and initial pull Wheel 10 (see FIG. 2) which pulls documents from the stack and towards guide 1 are mounted on drive shaft 33*a*. Similarly, both wheel 34 and second pull wheel 11 (see FIG. 2) which also pulls documents from the stack and towards guide 1 are mounted on shaft 34*a*. Wheels 36 and roller 14 (see FIG. 2) which pulls documents entering guide toward guide outlet 13 are mounted on shaft 36*a*. Finally, both wheel 35 and roller 15 (see FIG. 2) which pull documents entering guide 11 back toward guide entry 9 are mounted on shaft 35*a*.

When motor 20 is placed in motion shaft 20*a* begins to rotate, thereby rotating final pull wheel 18. When the one document has been selected for passing through the guide, the selected document is pulled by final pull wheel 18 toward guide outlet 13. Photo detector 19 will detect the selected document being pulled by final pull wheel 18 and will send a signal to disengage the clutch as to be more fully described later.

Up to the point of clutch disengagement, the clutch is operating, i.e. maintaining the engagement of drive shaft 28*a* and sprocket 29. As a result of the engagement of the clutch, all the pull wheels or rollers are being rotated by the rotation of drive shaft 28*a*. While pull wheel 14 is turning in the direction of advance, i.e. the direction which would move the document outward toward guide outlet 13, rollers 15, 15', 15'' are rotating in the opposite direction i.e. the direction which would move tend toward the guide entry 9. However, since the force of roller 14 is greater than that of the other rollers, the document pressed against it will be pulled through towards guide outlet 13, while the documents pressed against rollers 15, 15', 15'' will be pulled backwards towards the guide entry 9, thereby achieving the desired selection by allowing only one document to pass towards guide outlet 13. Such a result occur since documents resting against the rollers 15, 15', and 15'' are urged backwards until only one document is pressed against roller 14. When there is only one document in guide 1, the greater force of roller 14 causes the document to move forward where it can no longer be pulled by rollers 15, 15', 15''.

The feeder is provided with photo detector 19 to detect the selected document passing through guide 1 so that appropriate commands may be issued for proper operation of the feeder. The clutch, when activated (such as prior to the detection of a document by photo detector 19), causes the rotation as previously described of all the wheels including for the final pull wheel. Accordingly, when the clutch is activated, the clutching mechanism causes pull wheels 10 and 11 to pull documents from the stack and towards guide 1 and also causes the rotation of rollers 14 and 15, thereby selecting a single document in guide 1 to be pulled towards guide outlet 13.

When the clutch is deactivated by the selection of a single document to be passed through guide 1 and the detection of the selected document by photo detector 19, wheels 10 and 11, which cause the pull of documents towards guide 1, and rollers 14 and 15, which cause the selection of a single document, are stopped and only final wheel 18 remains in motion As motor 20 remains powered and shaft 20*a* continues to turn final wheel 18 will pull the selected single document, thereby discharging the selected document out of the feeder. The clutch will then reactivate after the selected document is no longer detected by photo detector 19.

It is further contemplated that by regulating the distance between the shafts of rollers 14 and 15 the separation of documents of different thicknesses can be achieved with greater effectiveness.

It is not considered necessary to make this description more extensive for any expert on the subject to be able to understand the scope of the invention and the advantages deriving therefrom. Furthermore, the materials, shape, size and arrangement of the components may be varied, as long as this does not involve an alteration of the essence of the invention. The terms used in the description of this report must always be taken in the broader rather than a limited sense.

Thus, there has been described and illustrated herein, a document feeder which will supply a printing device with documents one at a time. However, those skilled in the art will recognize that many modifications and variations besides those specifically mentioned may be made in the techniques described herein without departing substantially form the concept of the present invention. Accordingly, it should be clearly understood that the form of the invention described herein is exemplary only and is not intended as a limitation on the scope of the invention.

What is claimed is:

1. A document feeder for supplying documents to a document processing system comprising:

a plate for stacking a plurality of documents thereon, said plate having a slot therein;

a first wheel for pulling said documents, said plate inclined so that said stack of documents rest continually against the first pull wheel;

a pushing element for acting on said stack of documents, said pushing element guided by said slot, said pushing element exerting a substantially constant and uniform force on said stack of documents;

a guide having first and second sides, said documents passing one by one through said guide towards said processing system, said first wheel pulling said documents towards said guide; and selection means positioned within said guide for selecting documents to be passed one by one through said guide; wherein said selection means comprises a first roller placed on said first side of said guide, said first roller having first, second and third toric projections mounted thereon, and first, second and third rollers placed on said second side of said guide, said first roller on said second side positioned forward of said first roller on said first side and said second and third rollers on said second side, said second roller on said second side having first and second toric projections mounted thereon, said toric projections on said first and second sides defining a support surface through which said documents pass.

2. The document feeder according to claim 1 wherein said first roller placed on said first side of said guide rotates in a first direction which would pull documents through said guide and said first, second and third rollers placed on said second side of said guide rotates in a second direction opposite to said first direction, the force of rotation of said first roller on said first side being greater than the force of rotation of said rollers on said second side.

3. The document feeder according to claim 1 further comprising:

a final pull wheel for discharging documents passing through said support surface; and photo detector means for detecting documents being pulled by said final pull wheel;

wherein the rotation of said first wheel for pulling said documents and the rotation of said rollers comprising said selection means stop during the detection of a document by said photo detector means.

4. The document feeder according to claim 1 further comprising a lateral bar removably received by a corresponding opening in said plate, said bar capable of being inserted or extracted with respect to said plate so that said plate can support documents of differing lengths.

5. The document feeder according to claim 1 wherein said first wheel for pulling said documents further comprises a first projection, said first projection striking said stack of documents when said first wheel rotates, thereby separating documents stuck together.

6. The document feeder according to claim 5 wherein said first wheel for pulling said documents further comprises a second projection oppositely disposed to said first projection, said second projection also striking said documents when said first wheel rotates.

7. The document feeder according to claim 1 wherein said pushing element for acting on said stack of documents further comprises:

a pair of substantially parallel plates;

a first roller mounted between said pair of parallel plates;

said first roller having a wheel mounted thereon, said wheel guided by said slot of said inclined plate; and a third plate mounted between said parallel plates, said third plate pushing against said stack of documents.

8. The document feeder according to claim 1 further comprising a drive mechanism comprised of a motor and a drive shaft, said drive mechanism operable in two states, wherein the drive mechanism simultaneously rotates said first wheel for pulling said documents into said guide, said first roller placed on said first side of said guide and said first, second and third rollers placed on said second side of said guide, and said final pull wheel for discharging documents passing through said support surface in the first state and wherein the drive mechanism rotates the final pull wheel in the second state.

9. A document feeder for supply documents to a document processing system comprising:

a plate for stacking a plurality of documents thereon;

a first wheel for pulling said documents, said plate inclined so that said stack of documents rest continually against said first pull wheel;

a guide having first and second sides, said documents passing one by one through said guide towards said processing system, said first wheel pulling said documents towards said guide; and selection means positioned within said guide for selecting documents to be passed one by one through said guide; wherein said selection means comprises a first roller placed on said first side of said guide, said first roller having at least one toric projection mounted thereon, and first and second rollers placed on said second side of said guide, said first roller on said second side positioned forward of said first roller on said first side and said second roller on said second side, said second roller on said second side having at least one toric projection mounted thereon, said toric projections on said first and second sides defining a support surface through which said documents pass;

said first roller mounted on said first side rotating in a first direction which would pull documents through said guide and said first and second roller mounted on said second side rotating in a second direction opposite to said first direction, the force of rotation of said first roller mounted on said first side being greater than the force rotation of said first and second rollers mounted on said second side, said toric projections on said second side pulling documents in said second direction until only one remaining document presses against said toric projection on said first side, said toric projections on said first side pulling said remaining document through said support surface.

10. The document feeder according to claim 9 further comprising:

a final pull wheel for discharging documents passing through said support surface; and photo detector means for detecting documents being pulled by said final pull wheel;

wherein the rotation of said first wheel for pulling said documents and the rotation of said at least one rollers mounted on both said first and second sides of said guide stop during the detection of documents by said photo detector means.

11. The document feeder according to claim 10 further comprising:

a pushing element for acting on said stack of documents;

said inclined plate further including a slot therein; and wherein said pushing element guided by said slot, said pushing element exerting a substantially constant and uniform force on said stack of documents.

12. The document feeder according to claim 11 wherein said pushing element for acting on said stack of documents further comprises:

a pair of substantially parallel plates;

a first roller mounted between said pair of parallel plates;

a second roller mounted between said pair of parallel plates;

said first and second rollers each having a wheel mounted thereon, said wheels guided by said slot of said inclined plate; and a third plate mounted between said parallel plates, said third plate pushing against said stack of documents.

13. The document feeder according to claim 11 wherein said first wheel for pulling said documents further comprises a first projection, said first projection striking said stack of documents when said first wheel rotates, thereby separating documents stuck together.

14. The document feeder according to claim 13 wherein said first wheel for pulling said documents further comprises a second projection oppositely disposed to said first projection, said second projection also striking said documents when said first wheel rotates.

15. The document feeder according to claim 13 further comprising a second wheel for pulling said documents separated by said first wheel to said guide.

16. The document feeder according to claim 15 further comprising a drive mechanism comprised of a motor and a drive shaft, said drive mechanism operable in two states, wherein the drive mechanism simultaneously rotates said first wheel for pulling and separating said documents, said second wheel for pulling documents separated by said first wheel into said guide, said at least one roller mounted on said first side of said guide, said at least one roller mounted on said second side of said guide and said final pull wheel for discharging documents passing through said support surface in the first state and wherein the drive mechanism rotates said final pull wheel in the second state.

17. The document feeder according to claim 16 further comprising a lateral bar removably received by a corresponding opening in said plate, said bar capable of being inserted or extracted with respect to said plate so that said plate can support documents of differing lengths.

18. A document feeder for supply documents to a document processing system comprising:

a plate for stacking a plurality of documents thereon;

a first wheel for pulling said documents, said plate inclined so that said stack of documents rest continually against said first pull wheel;

a guide having first and second sides, said documents passing one by one through said guide towards the processing system, said first wheel pulling said documents towards the guide; and selection means positioned within said guide for selecting documents to be passed one by one through said guide, said selection means comprising a first roller positioned on said first side of said guide and first and second rollers positioned on said second side of said guide, said first roller on said second side positioned forward of said first roller on said first side and said second roller on said second side.

19. The document feeder according to claim 18 further comprising a lateral bar removably received by a corresponding opening in said plate, said bar capable of being inserted or extracted with respect to said plate so that said plate can support documents of differing lengths.

20. The document feeder according to claim 18 wherein said first wheel for pulling said documents further comprises a first projection, said first projection striking said stack of documents when said first wheel rotates, thereby separating documents stuck together.

21. The document feeder according to claim 20 wherein said selection means further comprises a third roller positioned on said second side of said guide, said first roller on said first side having first, second and third toric projections mounted thereon, and said second roller on said second side having first and second toric projections mounted thereon, said toric projections on said first and second sides defining a support surface through which said documents pass.

22. The document feeder according to claim 21 wherein said first roller placed on said first side of said guide rotates in a first direction which would pull documents through said guide and said first, second and third rollers placed on said second side of said guide rotates in a second direction opposite to said first direction, the force of rotation of said first roller on said first side being greater than the force of rotation of said rollers on said second side.

23. The document feeder according to claim 22 further comprising:

a final pull wheel for discharging documents passing through said support surface; and photo detector means for detecting documents being pulled by said final pull wheel;

wherein the rotation of said first wheel for pulling said documents and the rotation of said rollers comprising said selection means stop during the detection of a document by said photo detector means.

24. The document feeder according to claim 23 further comprising a drive mechanism comprised of a motor and a drive shaft, said drive mechanism operable in two states, wherein the drive mechanism simultaneously rotates said first wheel for pulling said documents into said guide, said first roller placed on said first side of said guide, said first, second and third rollers placed on said second side of said guide, and said final pull wheel for discharging documents passing through said support surface in the first state and wherein the drive mechanism rotates the final pull wheel in the second state.

25. The document feeder according to claim 20 wherein said first wheel for pulling said documents further comprises a second projection oppositely disposed to said first projection, said second projection also striking said documents when said first wheel rotates.

26. The document feeder according to claim 18 wherein said at least one roller mounted on said first side of said guide rotates in a first direction which would pull documents through said guide and said at least one roller mounted on said second side of said guide rotates in a second direction opposite to said first direction, the force of rotation of said at least one roller mounted on said first side greater than the force of rotation of said at least one roller mounted on said second side, said toroidal projections on said second side pulling documents in said second direction until only one document presses against said toroidal projections on said first side, said toroidal projections on said first side pulling said remaining document through said support surface.

27. The document feeder according to claim 26 further comprising:

a final pull wheel for discharging documents passing through said support surface; and photo detector means for detecting documents being pulled by said final pull wheel;

wherein the rotation of said first wheel for pulling said documents and the rotation of said at least one rollers mounted on both said first and second sides of said guide stop during the detection of a document by said photo detector means.

28. The document feeder according to claim 27 further comprising a drive mechanism comprised of a motor and a drive shaft, said drive mechanism operable in two states, wherein the drive mechanism simultaneously rotates said first wheel for pulling and separating said documents, said second wheel for pulling documents separated by said first wheel into said guide, said at least one roller mounted on said first side of said guide, said at least one roller mounted on said second side of said guide, and said final pull wheel in the first state and wherein the drive mechanism rotates said final pull wheel in the second state.

29. The document feeder according to claim 18 wherein said guide further comprises a wider portion and a narrower portion, said first roller on said second side being positioned in said wider portion of said guide and said first roller on said first side and said second roller on said second side being positioned in the narrower portion of said guide.

30. A document feeder according to claim 29 wherein said plate has a slot therein and wherein said document feeder further comprises a pushing element for acting on said stack of documents, said pushing element guided by said slot, said pushing element exerting a substantially constant and uniform force on said stack of documents.

31. The document feeder according to claim 29 wherein said pushing element for acting on said stack of documents further comprises:

a pair of substantially parallel plates;

a first roller mounted between said pairs of parallel plates;

said first roller having a wheel mounted thereon, said wheel guided by said slot of said inclined plate; and a third plate mounted between said parallel plates, said third plate pushing against said stack of documents.

32. A document feeder for supplying documents to a document processing system comprising:

a plate for stacking a plurality of documents thereon, said plate having a slot and an opening therein;

a lateral bar removably received by said opening in said plate, said bar capable of being inserted or extracted with respect to said plate so that said plate can support documents of differing lengths;

a pushing element for acting on said stack of documents, said pushing element guided by said slot, said pushing element exerting a substantially constant and uniform force on said stack of documents;

a first pull wheel for pulling and separating said documents, said plate inclined so that said stack of documents rest continually against said first pull wheel;

a second pull wheel;

a guide having first and second sides, said second pull wheel pulling documents separated by said first pull wheel to said guide, said documents passing one by one through said guide towards said processing system;

selection means positioned within said guide for selecting documents to be passed one by one through said guide, said selection means comprising a first roller placed on said first side of said guide, said first roller having first, second and third toric projections mounted thereon, and first, second and third rollers placed on the second side of said guide, said second roller on said second side having first and second toric projections mounted thereon, said toric projections on said first and second sides defining a support surface through which said documents pass;

a final pull wheel for discharging documents passing through said support surface; and photo detector means for detecting documents being pulled by said final pull wheel;

wherein the rotation of said first pull wheel and the rotation of said rollers comprising said selection means stop during the detection of a document by said photo detector means.

33. The document feeder according to claim 32 wherein said first roller on said second side is positioned forward of said first roller on said first side and said second and third rollers on said second side.

34. The document feeder according to claim 33 wherein said guide further comprises a narrower portion and a wider portion, said first roller on said second side positioned in said wider portion and said first roller on said first side and said second and third rollers on said second side positioned in said narrower portion.

35. The document feeder according to claim 34 wherein said first pull wheel further comprises a first projection, said first projection striking said stack of documents when said first wheel rotates, thereby separating documents stuck together.

36. The document feeder according to claim 35 wherein said first pull wheel further comprises a second projection oppositely disposed to said first projection, said second projection also striking said documents when said first pull wheel rotates.

* * * * *

UNITED STATES PATENT AND TRADEMARK OFFICE

CERTIFICATE OF CORRECTION

PATENT NO. : 4,986,523

DATED : January 22, 1991

INVENTOR(S) : Martin

It is certified that error appears in the above-identified patent and that said Letters Patent is hereby corrected as shown below:

On the title page, item 30, Foreign Application Priority Data

"May 4, 1988 [ES] Spain . . . . . 8801366" should read
- - May 4, 1988 [ES] Spain . . . . . 8801367 - -

Signed and Sealed this

Eighteenth Day of August, 1992

*Attest:*

DOUGLAS B. COMER

*Attesting Officer*

*Acting Commissioner of Patents and Trademarks*